US007542549B2

(12) United States Patent
Lesiak et al.

(10) Patent No.: US 7,542,549 B2
(45) Date of Patent: Jun. 2, 2009

(54) X-RAY SOURCE WITH NONPARALLEL GEOMETRY

(75) Inventors: Stanley D. Lesiak, Naperville, IL (US); Heinz H. Busta, Park Ridge, IL (US); Bruce M. Zwicker, Geneva, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 0 days.

(21) Appl. No.: 11/779,752

(22) Filed: Jul. 18, 2007

(65) Prior Publication Data

US 2008/0008294 A1 Jan. 10, 2008

Related U.S. Application Data

(62) Division of application No. 10/854,944, filed on May 27, 2004, now Pat. No. 7,274,772.

(51) Int. Cl.
*H01J 35/14* (2006.01)
*H01J 35/06* (2006.01)
*H01J 35/30* (2006.01)

(52) U.S. Cl. ..... 378/138; 378/136; 378/137

(58) Field of Classification Search ..... 378/119–124, 378/134–138; 250/455.11, 492.3
See application file for complete search history.

(56) References Cited

U.S. PATENT DOCUMENTS

| | | | |
|---|---|---|---|
| 2,501,290 | A | 3/1950 | Pequignot |
| 3,267,315 | A | 8/1966 | Hofmann |
| 4,289,969 | A | 9/1981 | Cooperstein et al. |
| 4,592,079 | A | 5/1986 | Sohval et al. |
| 4,757,524 | A | 7/1988 | Laul |
| 5,014,289 | A | 5/1991 | Rothe et al. |
| 5,077,749 | A | 12/1991 | Noda et al. |
| 5,461,656 | A | 10/1995 | Golovanivsky et al. |
| 5,577,090 | A | 11/1996 | Moses |
| 5,729,583 | A | 3/1998 | Tang et al. |
| 5,897,831 | A | 4/1999 | Jacob et al. |
| 6,181,765 | B1 | 1/2001 | Sribar et al. |

(Continued)

FOREIGN PATENT DOCUMENTS

| | | |
|---|---|---|
| DE | 19829444 | 1/2000 |

(Continued)

*Primary Examiner*—Irakli Kiknadze
(74) *Attorney, Agent, or Firm*—Thomas E. Omholt; Phillip M. Pippenger; Steven D. Weseman

(57) ABSTRACT

An improved x-ray generation system produces a converging or diverging radiation pattern particularly suited for substantially cylindrical or spherical treatment devices. In an embodiment, the system comprises a closed or concave outer wall about a closed or concave inner wall. An electron emitter is situated on the inside surface of the outer wall, while a target film is situated on the outside surface of the inner wall. An extraction voltage at the emitter extracts electrons which are accelerated toward the inner wall by an acceleration voltage. Alternately, electron emission may be by thermionic means. Collisions of electrons with the target film causes x-ray emission, a substantial portion of which is directed through the inner wall into the space defined within. In an embodiment, the location of the emitter and target film are reversed, establishing a reflective rather than transmissive mode for convergent patterns and a transmissive mode for divergent patterns.

5 Claims, 14 Drawing Sheets

U.S. PATENT DOCUMENTS

| | | | |
|---|---|---|---|
| 6,333,968 | B1 | 12/2001 | Whitlock et al. |
| 6,576,189 | B1 | 6/2003 | Wedekamp |
| 7,062,017 | B1 | 6/2006 | Runnoe |
| 2002/0085674 | A1 | 7/2002 | Price et al. |
| 2005/0232396 | A1 | 10/2005 | Chidester |

FOREIGN PATENT DOCUMENTS

| | | | |
|---|---|---|---|
| RU | 1805511 | A1 * | 3/1993 |

* cited by examiner

X-RAY SOURCE WITH NONPARALLEL GEOMETRY

FIELD OF THE INVENTION

This invention relates generally to x-ray generation and use, and, more particularly, relates to a system and method for generating a convergent or divergent x-ray emission pattern from a continuous source.

BACKGROUND

High-energy electromagnetic radiation in the form of x-rays has found use in a vast spectrum of fields and endeavors. The use of x-rays in medical imaging is probably the most familiar scenario to most people, but other uses abound as well. For example, x-rays may be used in a medical setting for purposes of activation, such as of a medication or substance, rather than for imaging. Moreover, many uses of x-ray radiation in ground and geological exploration are known, such as in connection with oil exploration or subsurface imaging. One effective use of x-ray radiation is in the treatment of substances to reduce biological and other contamination. For example, food can be irradiated to kill microorganisms, making the food safer to consume. Waste water or runoff may be irradiated in the same manner to reduce contamination.

However, as useful as x-rays are in some of these capacities, the efficiency with which that radiation is produced and directed is suboptimal at present. Typical x-ray sources comprise a point source electron producer, an accelerator, and a metal target. In operation, the electrons generated by the point source are accelerated through the accelerator, and impact the metal target. Upon impact of the high-energy electrons with the target, x-ray radiation is emitted.

Typically the emitted radiation spreads in a conical pattern beyond the region of impact depending upon the composition and configuration of the target, the energy and dispersal of the impinging electrons, etc. Given this divergent radiation pattern, it can be seen that the radiation dose at a given distance r from the region of impact falls off in approximately an inverse squared ($1/r^2$) manner. To effectively employ this radiation pattern at proper doses, a strong radiation field, accounting for the fall off with distance, must be generated, and the object of interest must be positioned properly in the radiation cone. Although some radiation sources use multiple point sources, or one or more mobile point sources, to make up for the suboptimal emission pattern, such systems have their own inherent drawbacks and complexities. In particular, complications involving source timing, positioning, etc. are commonplace.

BRIEF SUMMARY OF THE INVENTION

Embodiments of the invention provide a novel technique for x-ray generation and use. The technique described herein utilizes one or more emitting surfaces, rather than point sources. The geometry of the emitting surface and a target surface are such that, in embodiments of the invention, the impact of electrons from the emitting surface upon the target surface produces a convergent radiation field. In a further embodiment of the invention, the target surface is located at the outer surface of a tubular member, such that the convergent radiation field occurs within the tubular member. This is particularly useful for the radiation treatment of flowable materials such as liquids, gases, etc.

More generally however, the invention involves, in embodiments, the use of two members having similar concavity (not necessarily in degree but in direction) placed and configured such that electrons generated at one of the members accelerate between the members in a convergent or divergent manner and strike a metal target film at or on the second member. X-rays generated in response to these collisions radiate through and beyond the second member, or reflect from the second member, in a convergent pattern.

In an embodiment of the invention, multiple separate x-ray generation apparatus are used in series and/or in parallel to irradiate flowable materials including but not limited to liquids. In further embodiments of the invention, the space between the first and second members is evacuated to minimize electron loss and electron energy loss, thus allowing the electrons to efficiently gain energy while traveling between their surface of origin and an x-ray generation surface or element.

Additional features and advantages of the invention will be made apparent from the following detailed description of illustrative embodiments which proceeds with reference to the accompanying figures.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION

The invention pertains to x-ray generation and use, and encompasses, in embodiments of the invention, a novel system and technique for generating a convergent radiation field, particularly suitable for irradiation of flow through media, but amenable to other uses as well. In general overview, an architecture according to an example embodiment of the invention comprises an inner tube and an outer tube. Electrons are extracted from an emitter layer on the inner surface of the outer tube and accelerated towards the inner tube. Upon impact with a target layer on the outer surface of the inner tube, x-ray radiation is emitted. Since the points of impact will lie substantially uniformly about the surface of the inner tube, the resulting radiation field is essentially axially symmetric and convergent toward the center axis of the inner tube.

Figure 1:
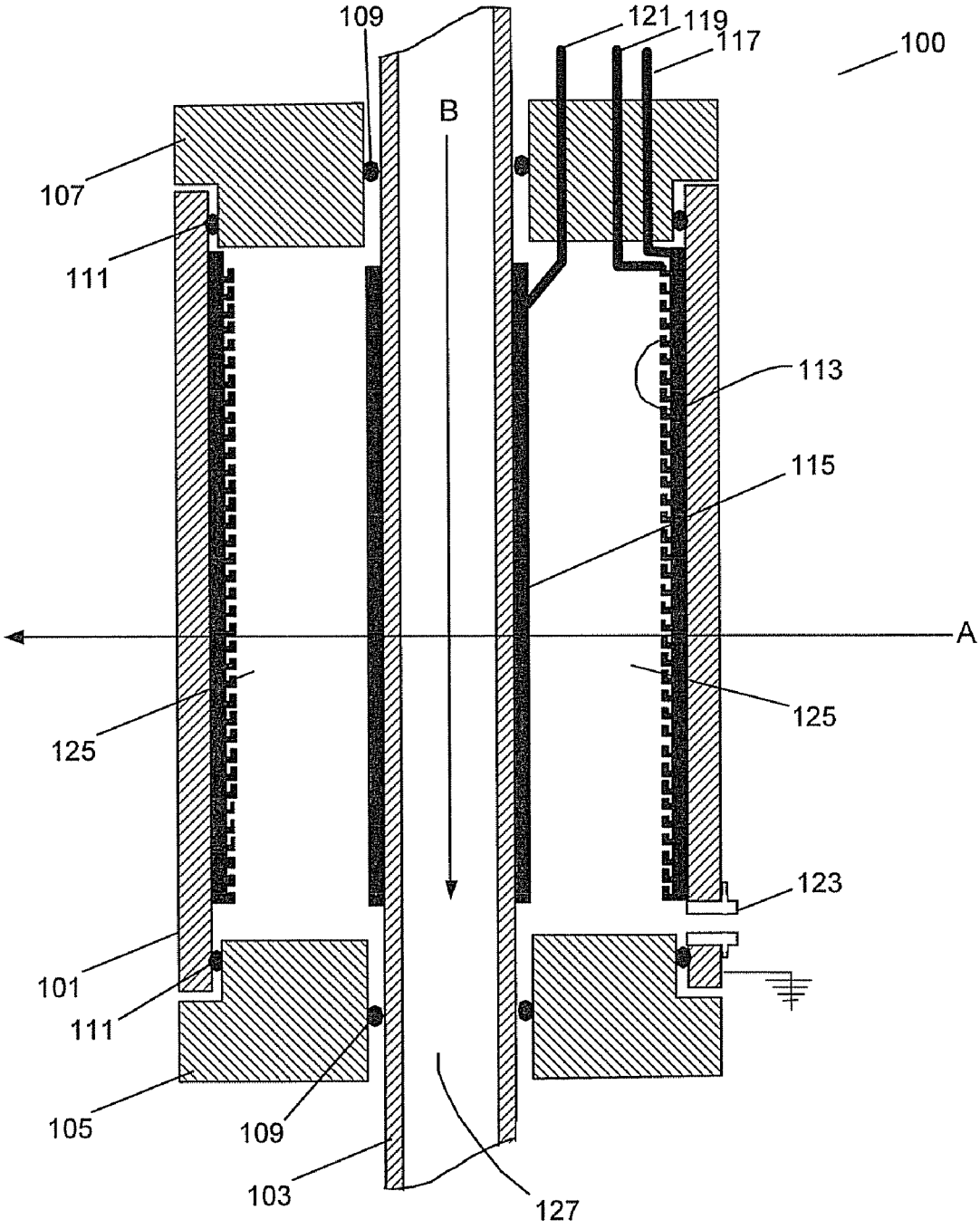
FIG. 1 is a cross-sectional side view of an x-ray generation apparatus according to an embodiment of the invention.

Embodiments of the invention will now be described in greater detail with reference to the accompanying drawings. Referring to FIG. 1, a cross-sectional side view of an x-ray generation apparatus according to an embodiment of the invention is shown. The x-ray generation apparatus 100 comprises a hollow tubular outer member 101 in a substantially coaxial relationship with a hollow tubular inner member 103. The inner 103 and outer 101 tubular members are held in their respective positions and maintained electrically isolated from one another by a first annular insulating end cap 105 and a second annular insulating end cap 107. The end caps 105, 107 may be in direct contact with the inner 103 and outer 101 tubular members, such as via a screwing or sliding contact. Alternatively, annular seals or gaskets 109, 111 may be interposed between the end caps 105, 107 and the inner 103 and outer 101 tubular members as shown, etc. Suitable seals and gaskets include rubber seals, such as Viton, or copper gaskets, etc. as will be appreciated by those of skill in the art.

An annular electron emitter source 113 such as a gated field emitter source is located along the inside wall of the outer tubular member 101. Similarly, an annular metal target layer 115 is situated on the outer surface of the inner tubular member 103, and may or may not be insulated from the inner tubular member 103 by an insulating layer, not shown. The metal target layer 115 and the gate of the gated field emitter source 113 are electrically accessible from outside the end cap 107. In an embodiment of the invention, respective leads 121 and 119 are connected to the components through the end cap 107, such as via high voltage feed throughs, as will be appreciated by those of skill in the art. In addition, the emitter film of the gated field emitter source 113 is electrically accessible via lead 117 through the end cap 107, such as via a high voltage feed through or similar mechanism.

Finally, the outer tubular member 101 has a portal 123 from outside of the outer tubular member 101 to the inner space 125 defined by the outer tubular member 101, the inner tubular member 103, and the end caps 105, 107. This portal is used primarily for evacuating the inner space 125 to vacuum (such as less than $10^{-6}$ Torr) during operation of the device 100, to minimize collisions of accelerated electrons with foreign molecules or particles after leaving the emitter film and before striking the metal target layer 115. In addition, the portal 123 may be used to backfill the inner space 125, such as with Nitrogen or other inert gas, when the device 100 is not in use.

Various materials can be used in the construction of the inner 103 and outer 101 tubular members. However, it is essential that both the inner 103 and outer 101 tubular members are able to sustain and withstand the vacuum level that is maintained in the inner space 125. In addition, it is desirable that the thickness and material of the inner tubular member 103 be such that the inner tubular member 103 is substantially transparent to x-ray radiation, such that any inwardly directed x-rays generated by collisions of accelerated electrons with the metal target layer 115 pass substantially through the wall of the inner tubular member 103 into the inner space 127 thereof. Exemplary materials of sufficient x-ray transmissivity include glass, plastic, thin metal, beryllium, quartz, graphite, boron nitride, etc.

In addition, with respect to the outer tubular member 101, it is desirable that this member be either substantially opaque to the x-rays generated by the instrument, or be coated with a material that is substantially opaque to such x-rays. This is because a portion of the x-rays generated within the device may be directed or be scattered outwardly. The shielding property of the outer tubular member 103 is thus important when it is desired to protect nearby personnel and/or materials from radiation damage. Preferably, the outer tubular member 103 is constructed of a reasonable thickness, such as 0.12", tubular stainless steel or aluminum, but any other material or materials can be used within the principles set forth above.

With respect to the metal target layer 115, this layer is preferably such that electron energies generated by the particular voltages and spacings used is sufficient to cause x-ray emission from the material. Suitable materials include, for example, Cu, W, Mo, etc. This layer may be deposited by vapor deposition, sputtering, etc., or may be placed, such as in the form of a foil.

As will be appreciated by those of skill in the art, the acceleration voltages usable in such a system are rather high, such that dielectric breakdown is a concern. Typical voltages are on the order of 10-500 kV. Moreover, electrical fields tend to concentrate at prominences or irregularities, such as the ends of the tubular members described above. In order to forestall dielectric breakdown, it is therefore generally desirable to minimize outcroppings and irregularities between the electron emission surface and the target x-ray generation surface or element.

Figure 2:
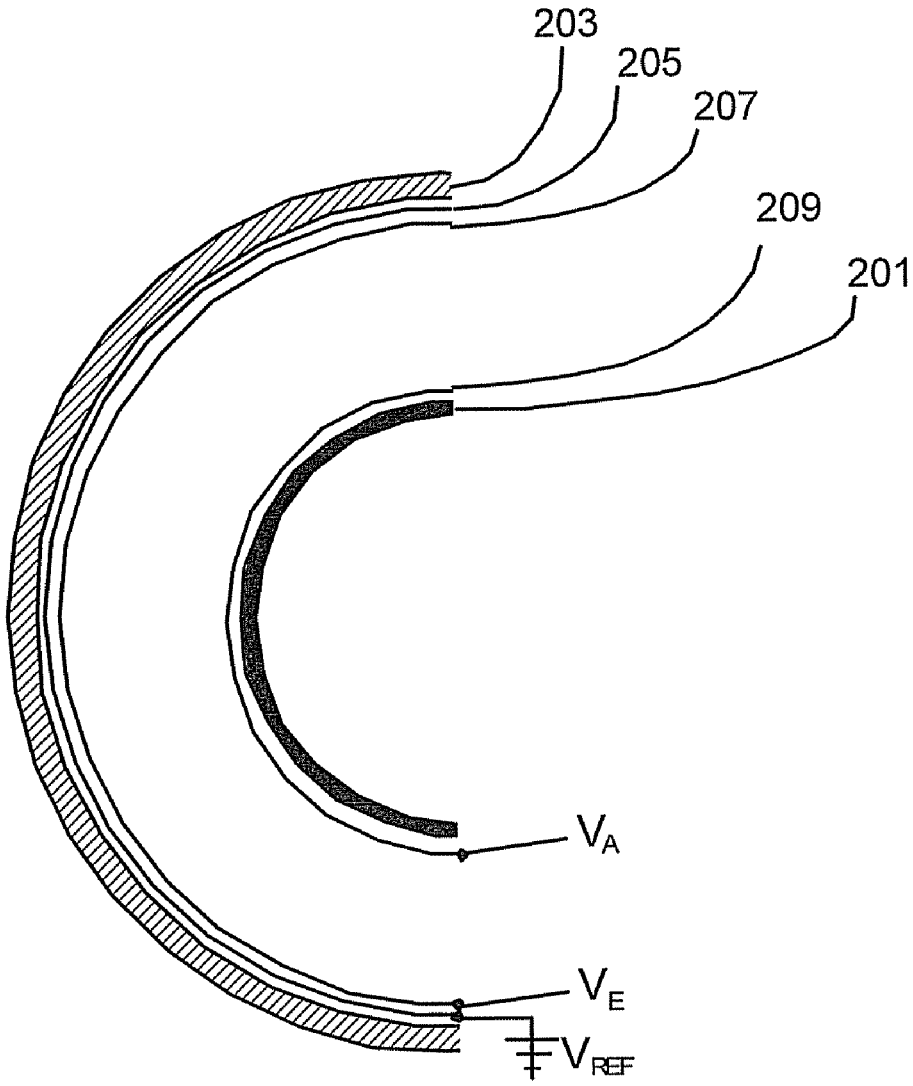
FIG. 2 is a cross-sectional side view of an x-ray generation apparatus according to a further embodiment of the invention.

FIG. 2 is a cross-sectional view of an x-ray generation device having electron emission and x-ray emission surfaces that are concave, with the concavity in substantially the same direction. While FIG. 2 can be seen to represent a cross sectional side view taken of a device of the configuration shown in FIG. 3A, it also applies to devices having cylindrical rather than spherical or hemispherical concavity.

The wall 203 of an outer tubular member can be seen in cross-section, as can the wall 201 of an inner tubular member. The emitter film and gate are indicated by respective elements 205 and 207. A metal target layer is similarly represented by element 209. The applied voltages are illustrated schematically as well, although it will be appreciated that in the assembled system, any high voltages, such as those supplied by lead 209, would typically be applied via high voltage feed throughs, and not simple leads.

It can be seen that the emitter film 205 is maintained at ground or reference voltage, $V_{REF}$. The emitter extraction grid (gate) 207 is maintained at an extraction voltage $V_E$, such that the potential $V_E - V_{REF}$ is sufficient to extract electrons from the emitter film 205. The metal target layer 209 is maintained at an acceleration voltage $V_A$. In operation, the electrons that are extracted from the emitter film 205 begin to accelerate once in the region between the gate 207 and the target layer 209. Their acceleration is essentially proportional to the electrostatic acceleration force applied, which is itself proportional to the voltage difference $V_A - V_E$, and inversely proportional to the radial distance between the gate 207 and the target layer 209. Although higher acceleration voltages yield higher electron energies, the maximum such voltage may be limited by the insulating limits of the end caps, feed throughs, etc., as well as by the onset of arcing or dielectric breakdown.

Figure 3A:
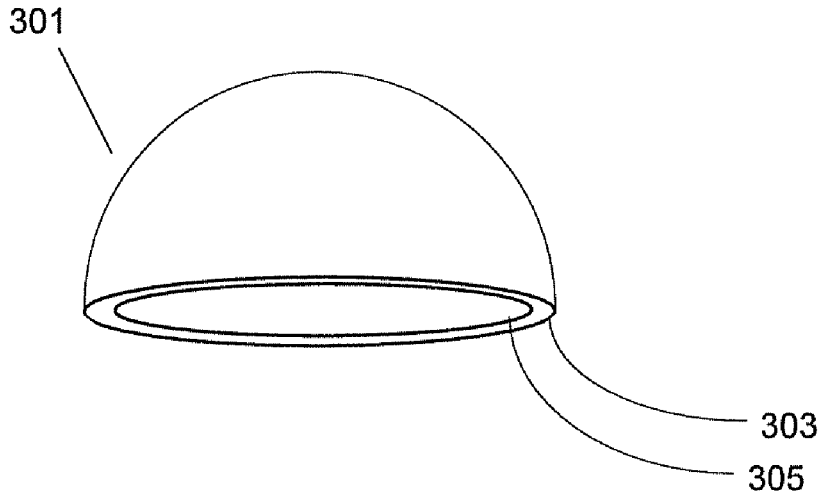
FIG. 3A is a perspective side view of a hemispherical x-ray generation apparatus according to an embodiment of the invention.
Figure 3B:
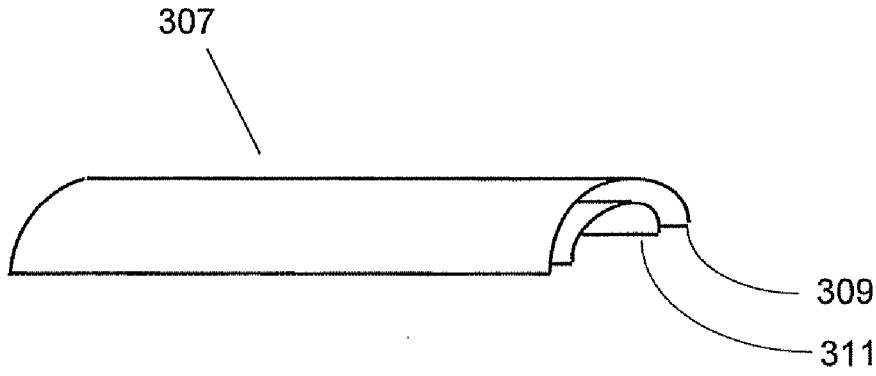
FIG. 3B is a perspective side view of an x-ray generation apparatus comprising inner and outer curved sheets in accordance with an embodiment of the invention.

Although some of the systems described above utilize concentric tubular members, it will be appreciated that a number of other geometries can employ the same principles to yield a cylindrically or spherically convergent x-ray field. An exemplary selection of such arrangements are shown in FIGS. 3A-B. In particular, in FIG. 3A, a hemispherical x-ray generation apparatus 301 is shown. An inner 305 and outer 303 shell perform the same functions as the inner and outer tubular members of the aforementioned embodiment. In particular, the space between the shells 303, 305 is an electron acceleration region, with a target layer (not shown) being disposed on the outside of the inner shell 305, and an electron emitter, gated or otherwise (not shown), being disposed on the inside of the outer shell 303. In order to evacuate the electron acceleration region, the edges of the shells 303, 305 may be sealed together, such as by an insulating end ring, or the apparatus may simply be used within a separate evacuated chamber.

It will be appreciated that since the inner shell 305 is concave, the generated radiation field will be substantially convergent in a region near the center of the concentric spherical shells 303, 305. It will be appreciated that additional non-convergent radiation fields may also be generated, but such are not of interest here. As illustrated, in an embodiment of the invention, the foci of the concentric spherical shells 303, 305 lie within or upon a partially enclosed target volume defined by the inner shell 305.

The concavity of the inner 305 and outer 303 shells can be controlled to define the convergent pattern of emission produced by the device. For example, more focused concavities will tend to tighten or narrow the emission pattern while less focused concavities will tend to broaden the pattern. In this way, the cross section of the convergent pattern of emission may be confined largely to any desired extent, such as 10 degrees, 45 degrees, 90 degrees, 180 degrees, 270 degrees, etc. or any intermediate value without limitation. With respect to spherical or partial spherical geometries, the convergent pattern of emission may be confined in the same way, i.e. it lay be largely confined to $\pi$ steradians, $2\pi$ steradians, and so on, or any intermediate value.

An alternative arrangement is shown in FIG. 3B. In particular, an x-ray generation apparatus comprises inner 311, and outer 309 curved sheets. Analogously to the embodiment of the invention discussed above, the inner 311 and outer 309 sheets perform the same functions as the inner and outer tubular members. The space between the sheets 309, 311 is an electron acceleration region, with a target layer, not shown, being disposed on the outside of the inner sheet 311, and a gated or ungated emitter, not shown, being disposed on the inside of the outer sheet 309. Again, in order to evacuate the electron acceleration region, the edges of the sheets 309, 311 may be sealed together, such as by an insulating edge fitting, or the apparatus may simply be used within an evacuated chamber. Moreover, since the inner sheet 311 is concave, the generated radiation field will be substantially radially convergent within or near the volume defined inside the inner sheet 311.

Figure 4:
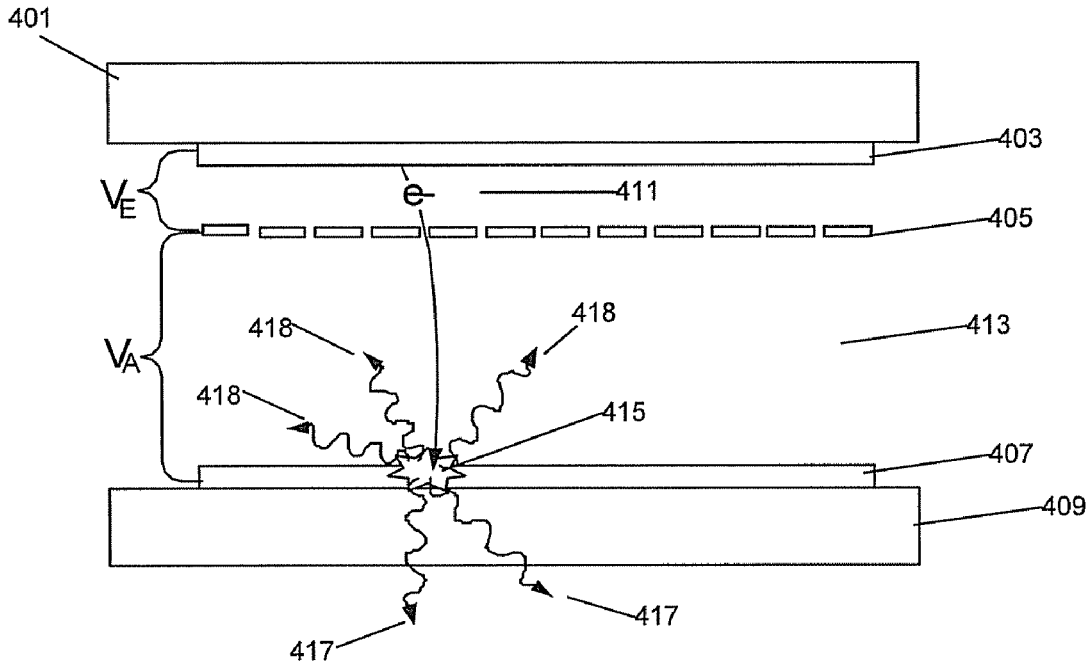
FIG. 4 is a simplified schematic drawing of a portion of an x-ray generation apparatus according to an embodiment of the invention with concavity omitted for clarity.

For the reader's convenience, a brief description of the electron extraction and acceleration processes as well as the x-ray emission process are given with reference to FIG. 4. FIG. 4 illustrates a simplified schematic drawing of a portion of the x-ray generation apparatus, with concavity omitted for ease of understanding. A section 401 of an outer wall has thereon a section 403 of emitter film and an extraction gate 405. A section 409 of an inner wall has thereon a section 407 of a target metal film or foil. In operation, viewing the path of a single electron, that electron 411 is extracted from the emitter film 403 by the extraction voltage $V_E$, and accelerated toward the inner wall 407 by the acceleration voltage $V_A$.

After traversing the interwall space 413, and accelerating therein, the electron impacts the metal target film 407 at a point 415. The impact generates one or more photons 417 having energy in the x-ray range. Although the illustrated x-rays 417 are shown to be directed toward the center of the device, some x-rays 418 may also scatter backward toward the outer wall (or in a tubular assembly, pass out the far side of the inner tubular member and continue toward the opposite point on the outer tubular member). Thus, as noted above, the outer wall should have shielding properties or include a shielding layer.

Figure 5:
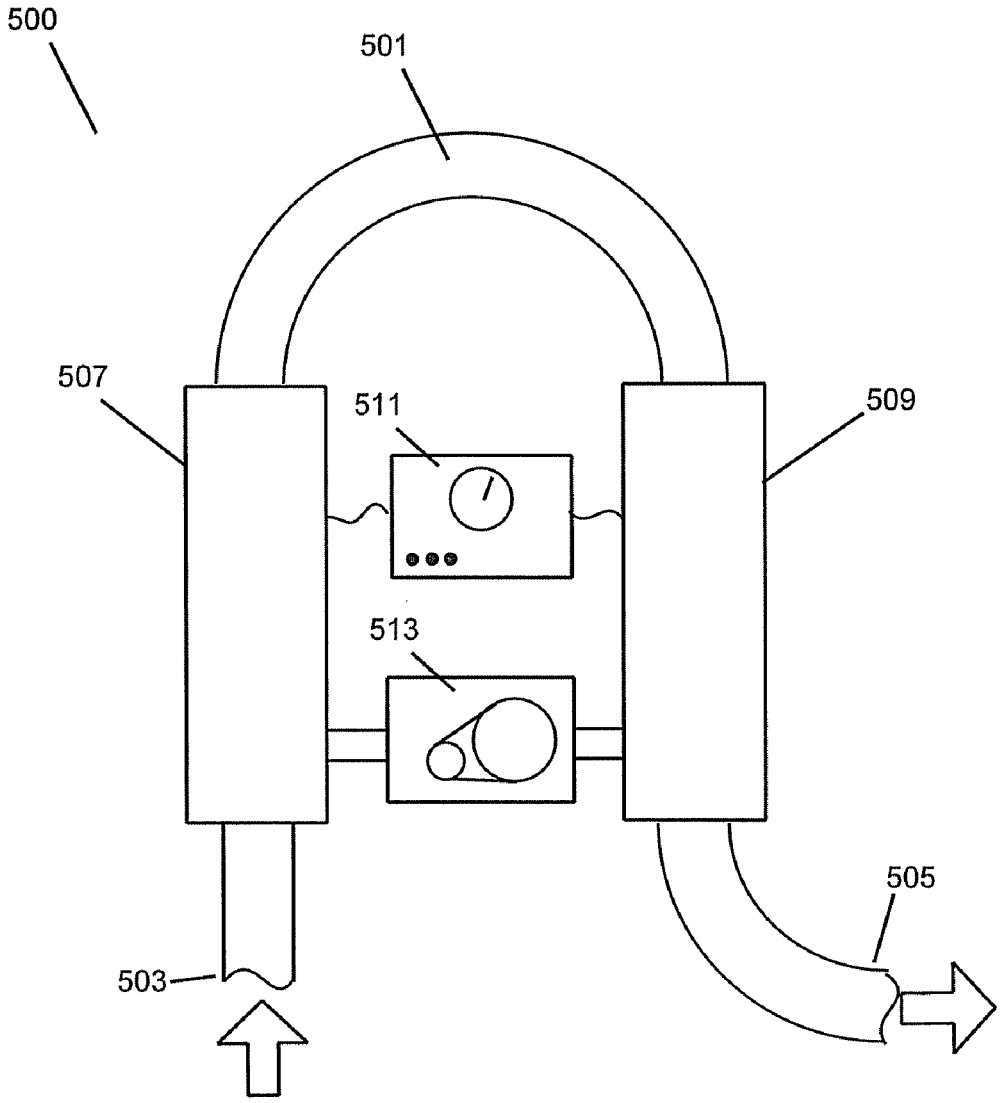
FIG. 5 is a schematic drawing of a multi-pass flow-through treatment system and component x-ray generation apparatus in accordance with an embodiment of the invention.

Having described a number of x-ray generation apparatus according to example embodiments of the invention, some exemplary uses of such systems according to further embodiments of the invention will now be discussed. FIG. 5 shows a multi-pass flow-through treatment system 500 and component x-ray generation apparatus, as described above, in high level schematic form. The system 500 comprises a pipe or conduit 501 having an inlet 503 and an outlet 505, and passing through first 507 and second 509 x-ray generation apparatus such as described above with respect to FIG. 1. A shared pump 513 and electrical supply 511 are shown connected to each x-ray generation apparatus 507, 509.

After liquid matter is passed into inlet 503, it passes first through the first x-ray generation apparatus 507, and the flow then returns through the second x-ray generation apparatus 509, before the material is expelled from the outlet 505. During each pass through an x-ray generation apparatus, the liquid is irradiated with x-ray radiation, generated and directed in the manner described above. In this way, any biological or chemical components susceptible to this type of radiation will be killed, destroyed, or modified to a desired form. It should be noted that the intensity and energy spectrum of radiation needed should be calculated based on the material that one desires to irradiate, including its x-ray absorption characteristics, desired end-product(s), as well as the concentration of microbes, target material, etc. to be affected. For example, it may desired to cause the breakdown of PCBs. If the chlorine atom of the molecule is removed via severance of its bond with x-ray radiation, harmless end-products such as HCl, water, and $CO_2$ result. As the above example points out, one can target specific reactions by tuning the x-ray radiation.

Another example of this is in facilitating flow-through, rather than batch, polymerization. Appropriate monomers and/or oligomers can be passed through any of the systems described above. The x-rays generated by the system can then cause ionization to induce free radical polymerization. In addition to the many benefits provided by such continuous processing, this system also provides an improvement over traditional UV polymerization, in that x-rays have lower extinction. An e-beam device as described elsewhere herein may also be used in this manner, although allowances would be necessary to account for the fact that high-energy electrons typically experience increased extinction.

Figure 6:
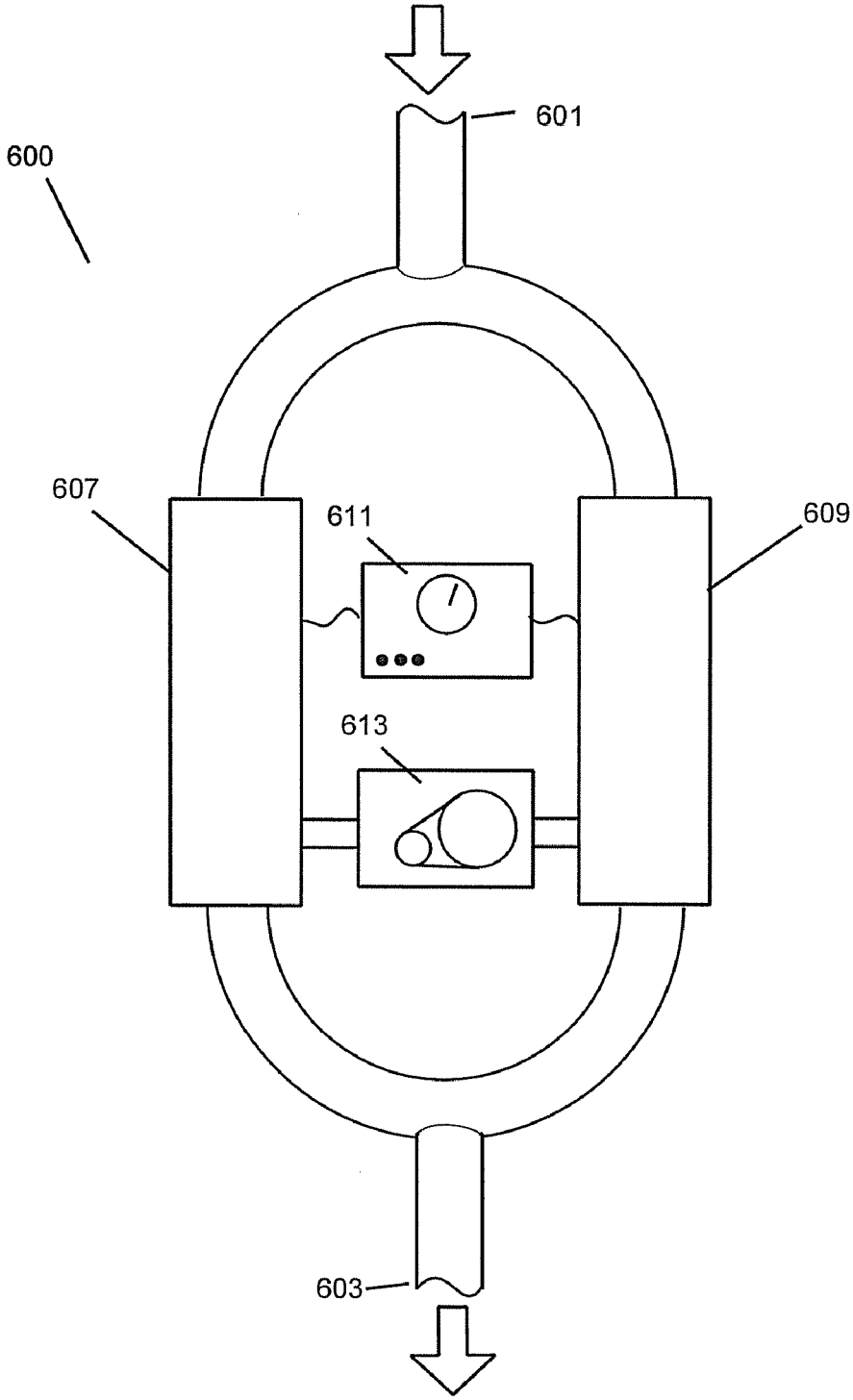
FIG. 6 is a schematic drawing of a single-pass parallel treatment system comprising dual x-ray generation apparatus in accordance with an embodiment of the invention.

In another embodiment of the invention, wherein it is necessary to treat a larger quantity of material, or to very rapidly treat a given amount of material, the subject material may be treated in a parallel fashion as shown in FIG. 6 with high throughput. In particular, the single-pass parallel treatment system 600 of FIG. 6 comprises dual x-ray generation apparatus 607, 609 such as those described above with reference to FIG. 5, as well as a shared pump 613 and electrical source 611. However, unlike the apparatus shown in FIG. 5, the treatment system 600 treats waste in a single pass but provides multiple paths to improve throughput. Thus, liquid material entering into inlet 601 may pass through either but not both of x-ray generation apparatus 607, 609. After treatment in the x-ray generation apparatus 607, 609, the liquid is combined and exits at outlet 603.

It is desirable in an embodiment of the invention that the treatment systems according to FIGS. 5 and 6 be able to be disassembled for maintenance, storage, or shipping. Thus, the inlets, outlets and connecting pipes, conduits, etc. are preferably removable and reinstallable, such as via standard vacuum, plumbing, and electrical hardware.

It should be noted that the treatment systems described above are merely examples, and any combination and configuration of elements is possible within the invention. For example, a parallel system that includes multiple x-ray generation apparatus in each path are possible, as well as a series treatment system comprising a series of parallel subsystems. Moreover, although shared components are shown, there is no limitation to the invention in that regard, and the x-ray generation apparatus may use dedicated or shared support equipment as desired.

The configuration and operation of a prototype device according to one embodiment of the invention is described in more detail below. The device is preferably configured and operated such that the generated x-rays irradiate the material to be treated with a dose at the center of the tube of approximately 1000 gray. This dose level is generally adequate to kill bacteria in foodstuffs and is also generally of sufficient energy to dissociate elemental bonds within, for example, waste water compounds.

Figure 7:
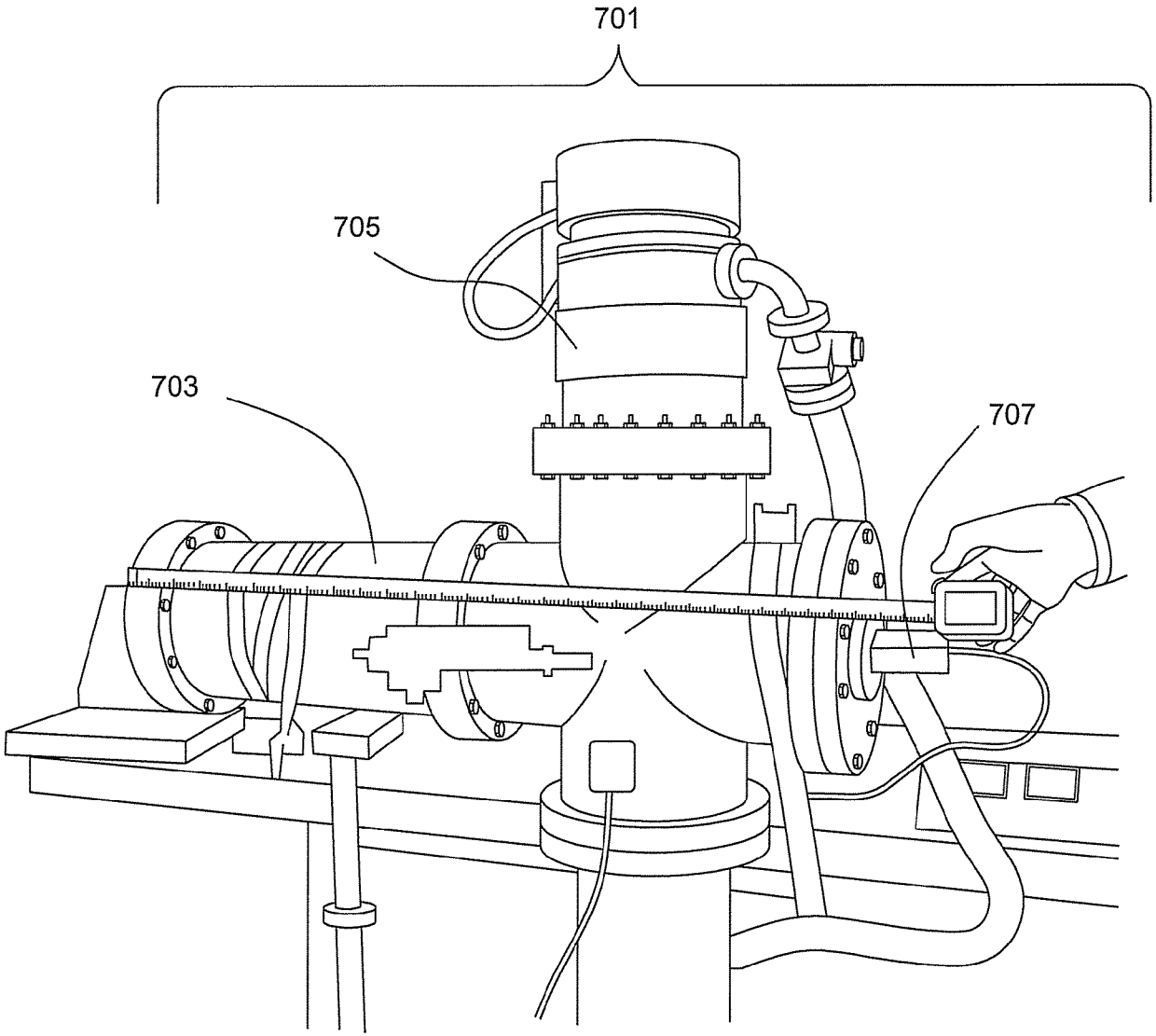
FIG. 7 is a photograph of a prototype x-ray generation apparatus according to an embodiment of the invention.

The prototype device 701 is shown in FIG. 7. The device is approximately 36" long and 60" high, although neither measurement is critical and either or both may be instead much greater or much less without departing from the scope of the invention. The visible outer container 703 of the device corresponds to the outer tube of the device, such as tube 101 of FIG. 1. The device is similar to that shown schematically in FIG. 1, although the emitter layer of the prototype is not gated, i.e. the prototype x-ray source is operated in the diode mode. The device 701 consisted of a 2" long section of a graphite cylinder with a diameter of 3.315 inches, concentrically positioned surrounding a 3" diameter quartz tube, onto which a 12.5 μm thick copper foil was wrapped and soldered. Thus, the graphite tube corresponds to the emitter layer 113 (omitting the gate) of FIG. 1, while the copper foil corresponds to the annular metal target layer 115. The 3" diameter inner quartz tube corresponds to the hollow tubular inner member 103 of FIG. 1.

As will be appreciated by those of skill in the art, high and ultrahigh vacuum levels are typically attainable only by multi-stage pumping. For example, high vacuum (on the order of $10^{-6}$ torr) may be achieved by pumping of the chamber by a turbo molecular pump backed by a mechanical or "roughing" pump. Ultrahigh vacuum may be achieved (in an appropriate chamber) by first pumping to high vacuum such as by the system described above, and then switching to a UHV-capable pump such as an ion pump. For most embodiments of the invention, high vacuum levels are sufficient, and ultrahigh vacuum is unnecessary. Thus, the prototype utilized a turbo molecular pump 705 backed by a mechanical roughing pump, not shown.

Figure 11:
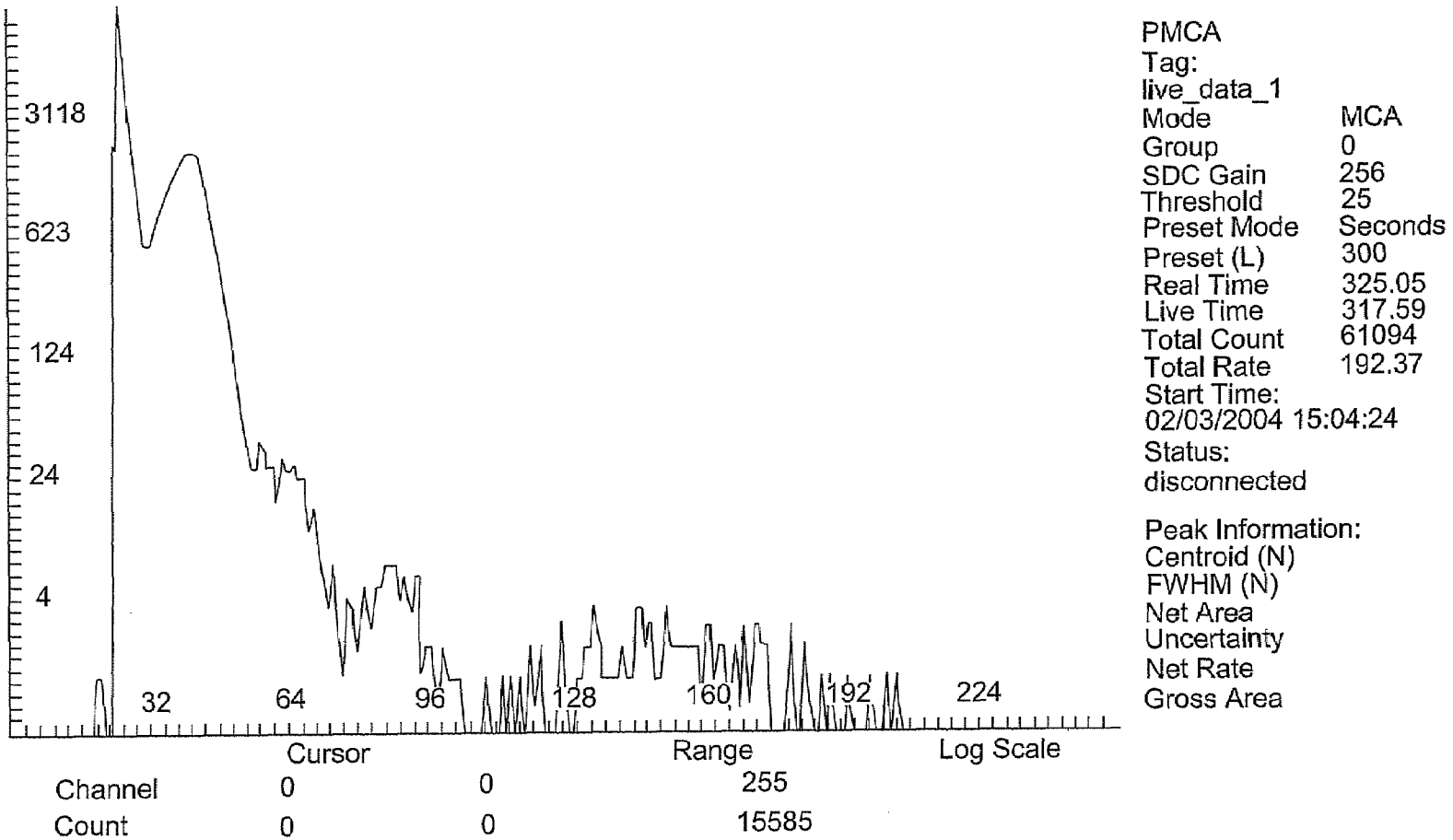
FIG. 11 is a plot of an x-ray spectrum at 40 kV electron energy within a device according to an embodiment of the invention.

A typical x-ray spectrum taken within space 127 at 40 kV electron energy is shown in FIG. 11. The ordinate of the plot shown in the figure represents photon counts while the abscissa represents photon energy. The base pressure of the device 701 was stabilized at about $5.1\times10^{-7}$ torr.

In an embodiment of the invention, a deposited copper film rather than copper foil is used as a metal target layer. In another embodiment of the invention, a molybdenum target layer is used. Although tungsten may also be used, molybdenum is preferred for ease of coating.

Note that although the prototype is a transmission mode device, it would also work configured similarly but in a reflective mode, as discussed in greater detail below. In an embodiment of the invention, the field emitter is replaced by a thermionic emitter. The thermionic device can also be operated in either the reflective or transmissive mode.

The embodiments of the invention described to this point use as an example electron emission near the outer tube 101 resulting in x-ray emission near the inner tube 103. However, in this mode, referred to as transmission mode (since the x-rays must pass at least partially through the metal target layer depending upon where in its depth they are generated), the x-ray intensity may be decreased somewhat due to reabsorption in the target layer (e.g. layer 115). To mitigate this problem, a reflective mode is also usable. Example devices operable in the reflective mode will be described with reference to FIGS. 8 and 9.

Figure 8:
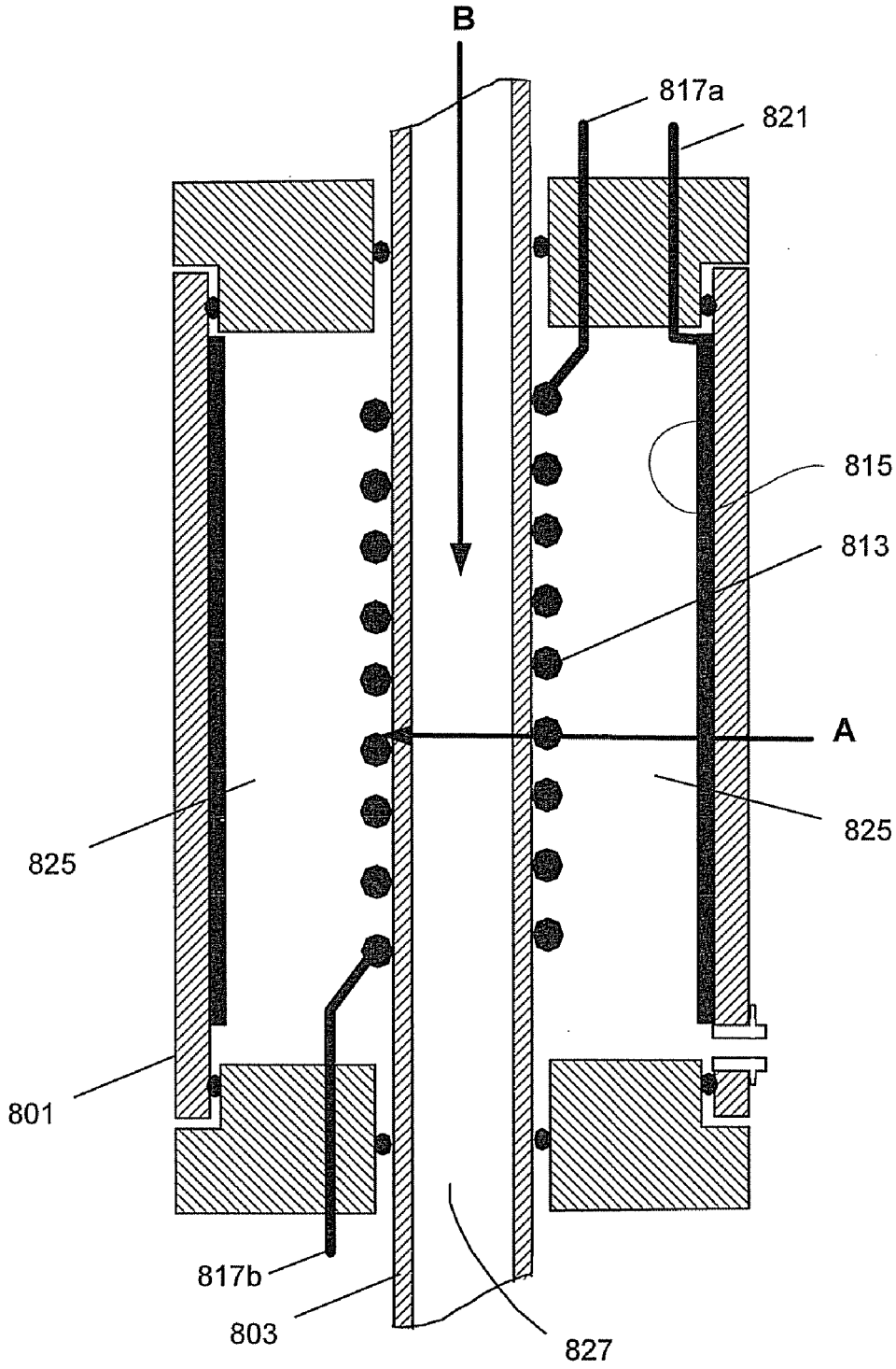
FIG. 8 is a cross-sectional side view of an x-ray generation apparatus according to an alternative embodiment of the invention.

FIG. 8 shows a cross-sectional side view of a cylindrical x-ray generation apparatus similar to that shown in FIG. 1. However, the apparatus of FIG. 8 differs from that of FIG. 1 in two primary aspects. First, the apparatus of FIG. 8 is in a reverse configuration in that the electron-generating element 813 is at the outer surface of the inner tube 803, while the electron target (x-ray generating) element 815 is at the inner surface of the outer tube 801. Secondly, the device shown in FIG. 8 is a diode device (due to the non-gated electron emitter 813) rather than triode device as in FIG. 1. The latter distinction is not as significant, and it should be noted that both transmissive and reflective devices may be configured and operated in either diode or triode mode depending upon builder preferences. For example, it will be appreciated by those of skill in the art that a device such as the device of FIG. 1 may use a thermionic emitter layer in place of field emitter layer 113. Moreover, although the reflective device of FIG. 8 is described as configured as a thermionic diode mode device, it will be appreciated that a gated emitter layer may be used instead of element 813.

The electron emission element 813 as shown in FIG. 8 is a wire wrapped around an insulating inner tube 803. The spacing of the wire wraps as illustrated is about 50%, although much greater or lesser spacing may be used. The electron generation characteristics and x-ray absorption characteristics of the wire 813 can be used to determine an optimal spacing if such is desired. Note that a thermionic emission element may become very hot in operation, and thus it may be desirable depending upon the material of the inner and/or outer tube, to maintain the thermionic emission element at a distance from one or both tubes by using insulating spacer rods or the like. An exemplary arrangement is discussed later below with reference to FIG. 10.

The target layer 815 may be a copper film or foil as in the transmissive mode, but may be much thicker since x-ray transmission through the layer is not desired or needed. Other materials such as molybdenum, tungsten, etc. may be used instead for this layer 815. The desired quality of the target layer 815 is that it emits x-rays when impacted by electrons of sufficiently high energy.

The target layer 815 is connected to a voltage source via lead 821, while the electron generation element 813 is connected to a voltage source via leads 817*a* and 817*b*. In this case, the relative voltages at the ends of the wire 813 establish the current through the wire, while the voltage differences between the target layer 815 and points on the wire 813 will establish the impact energy of emitted electrons.

When operated in the thermionic diode mode as shown, a voltage is applied across the electron generating element 813, and a voltage is applied to the target layer 815. The resultant field strength is sufficient to accelerate the emitted electrons toward the target layer 815 such that they attain impact energies sufficient to cause x-ray generation in the target layer 815. As the target layer is not very transmissive to x-rays, a majority of the generated x-rays are reflected or directed toward the interior of the device. Much of this radiation will either strike the generating element 813 or instead pass between the coils of the element 813 and thus enter the inner space 827 to irradiate its contents. The voltages may be set to achieve the desired level of radiation given the geometry, configuration, and materials of the device.

Figure 9:
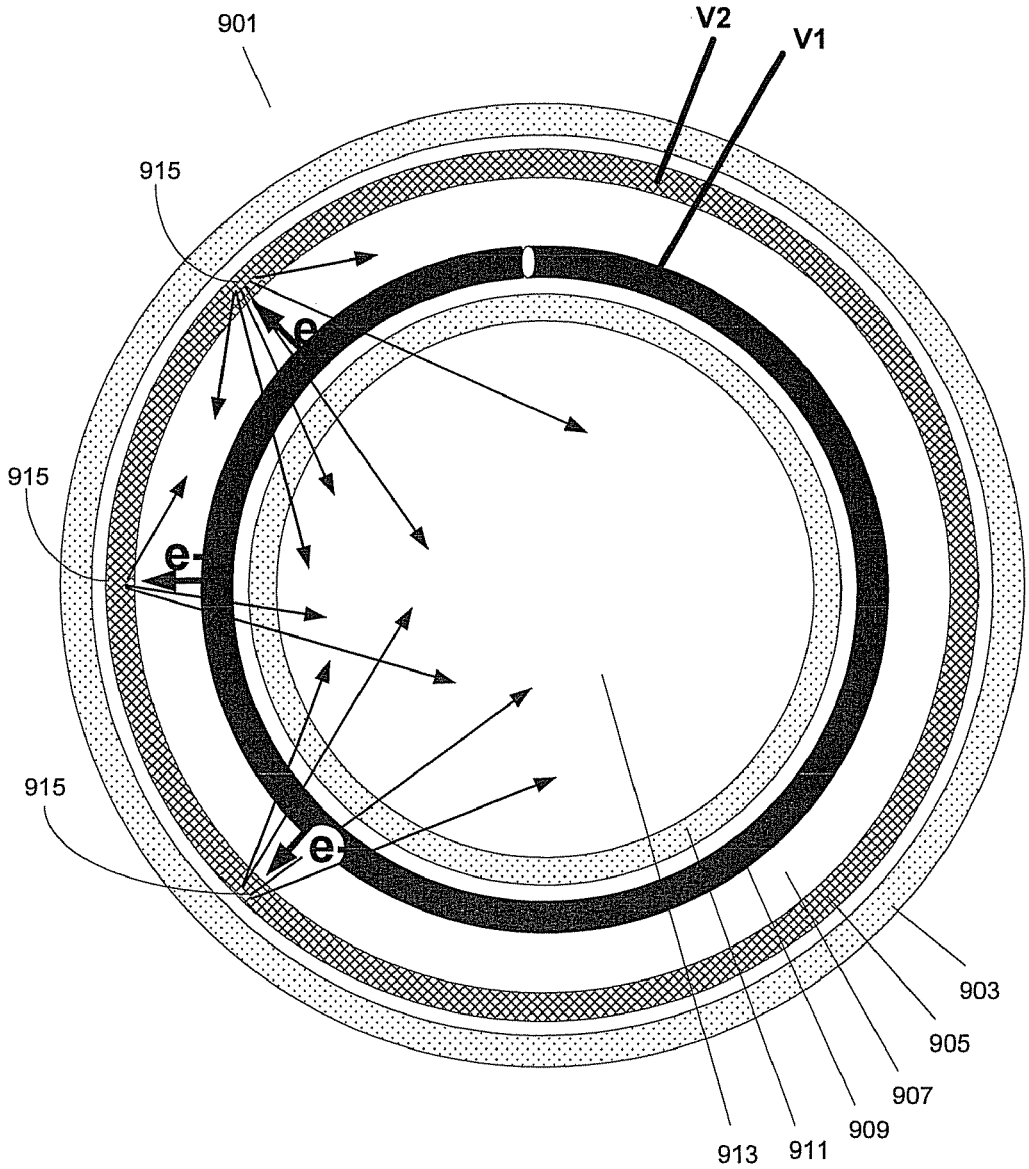
FIG. 9 is a cross-sectional end view taken along direction B of FIG. 8 at the level of line A in an embodiment of the invention.

FIG. 9 illustrates the electron and x-ray emission processes in greater detail. FIG. 9 shows a cross-sectional top view of a thin slice taken along line B, and at about line A, of FIG. 8. The device 901 comprises, in inward concentric order, an outer tube 903 (801), an electron target and x-ray emission layer 905 (815), an electron/x-ray traversal space 907 (825), an electron emission element 909 (813), an inner tube 911 (803), and a target volume 913 (827) for irradiation of flow through materials. In operation a voltage is applied across the electron emission element 909, and an average voltage of $V_1$ is also established at points on the element 909, and a voltage $V_2$ is applied to the electron target and x-ray emission layer 905. The voltage difference $V_2-V_1$ is typically on the order of 10-500 kV as discussed above, although greater or smaller voltages may be used.

As a result of the applied voltage differential, electrons are emitted from the electron emission element 909 and accelerated toward the electron target and x-ray emission layer 905. Although only three electrons are shown for the sake of clarity, it will be appreciated that an immense number of electrons will typically be generated at operational voltages. The electrons so accelerated impact the electron target and x-ray emission layer 905 at impact zones 915, resulting in the generation of x-ray radiation from many such zones 915. Although each illustrated zone 915 displays x-ray emission, it will be appreciated that x-ray emission does not invariably occur at each impact zone. Moreover, although the x-ray radiation is illustrated as being inwardly directed, it will be appreciated that some generated x-ray radiation may be differently directed.

As illustrated, a portion of the generated x-ray radiation is directed toward the target volume 913. Keeping in mind that in the illustrated embodiment of the invention the electron emission element 909 is a spirally wound wire, a portion of the radiation directed toward the target volume 913 is stopped by the electron emission element 909, while another portion passes between the coils of the element 909 and the inner tube 911 and enters the target volume 913 to irradiate its current contents.

It will be appreciated that the illustrated reflective mode device is subject to a great deal of variance within the scope of the invention. For example, the electron emission element 909 may be a sheet, ribbon, film or foil instead of a wire. Moreover, for thermionic emission, the material of the element 909 may be any suitable material including without limitation graphite, metal, or metal alloys, or nonmetal alloys, or combinations of these. For example, Thoriated Tungsten or Lanthanum Hexaboride are suitable materials. Moreover, the mechanism of electron emission may be any suitable mechanism, including without limitation thermionic emission, field emission, etc. Moreover, the electron target and x-ray emission layer 905 may be any suitable material and configuration. For example, copper, tungsten, molybdenum, or any other suitable material may be used, and the configuration of the layer 905 may be partial or continuous, and may act as an x-ray shield or may not. Moreover, although the geometry of the reflective device shown in FIGS. 8 and 9 is cylindrical, it will be appreciated that any other suitable geometry such as those described above or otherwise may be used within the scope of the invention.

Figure 10:
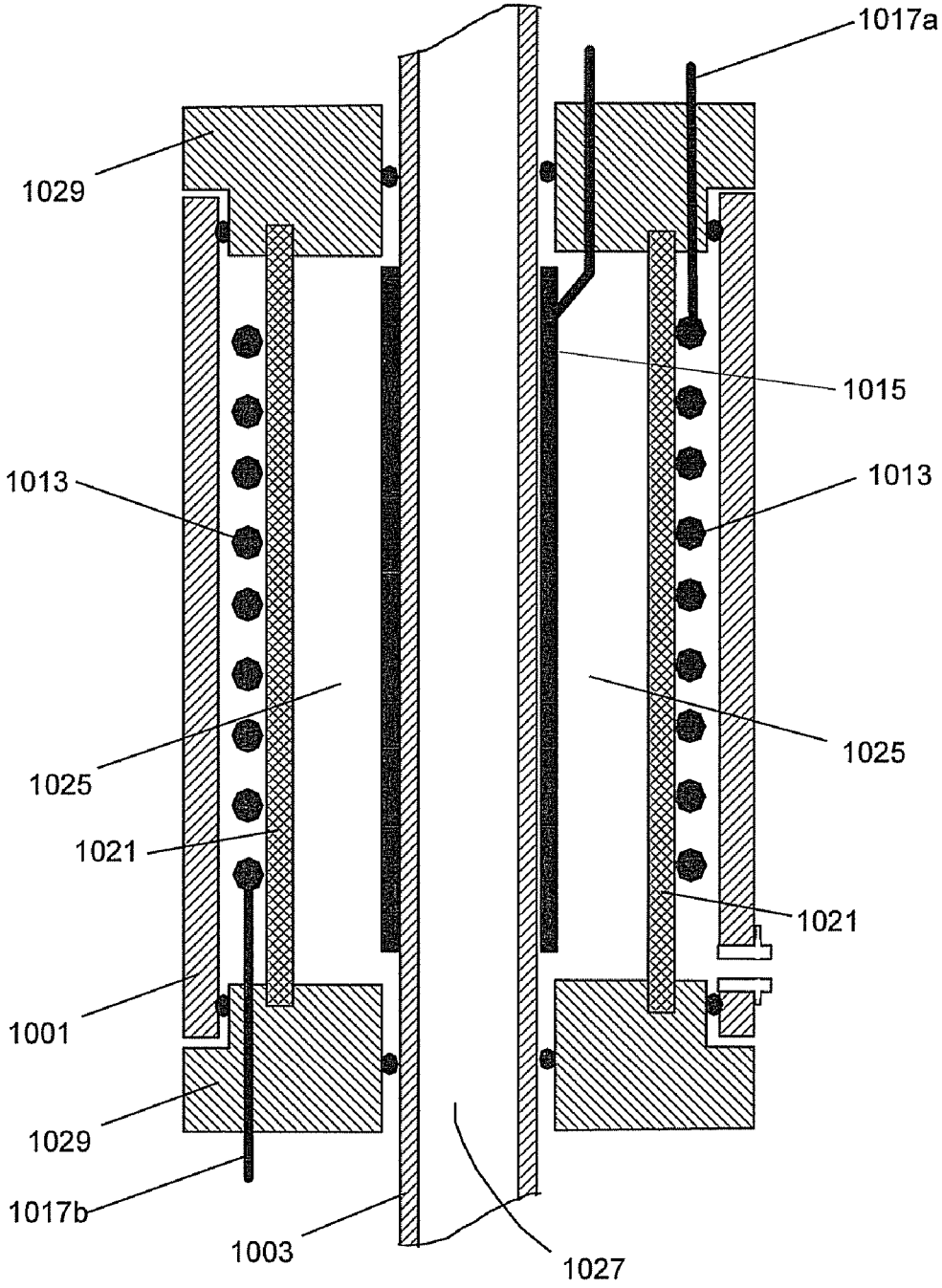
FIG. 10 is a cross-sectional side view of an x-ray generation apparatus according to another alternative embodiment of the invention.

FIG. 10 illustrates, in cross-sectional side view, a thermionic diode mode transmissive x-ray generation device similar in some regards to the device of FIG. 8. A thermionic electron emitting wire or filament 1013 is wound about a cylindrical arrangement of quartz support rods 1021. Electrical leads 1017*a* and 1017*b* allow current to be passed through element 1013. An outer tube 1001 encloses the electron emitting filament 1013 and the quartz support rods 1021, as well as an inner tube 1003, upon which is situated a metallic target material 1015 responsive to electron bombardment to generate x-rays. End caps 1029 are also provided and situated such that the space 1025 between the inner 1003 and outer 1001 tubes can be evacuated.

In operation, the electron emitting filament 1013 is resistively heated by the flow of electrical current there through, resulting in the emission of electrons. An acceleration field is established between the filament 1013 and the target material 1015 by applying appropriate voltages to these elements such that the emitted electrons accelerate toward and strike the target material 1015. The x-rays generated from such impacts are directed in many directions, but a substantial number are directed toward a target volume 1027 within the inner tube 1003. A portion of this x-ray radiation passes through the target material 1015 and the inner tube 1003 and enters the target volume 1027. In this manner, the contents of the target volume can be effectively irradiated.

A number of other modes of operation are available within the invention, given the principles taught above. In general, an x-ray generation device in accordance with the invention may operate in either a field emission or thermionic emission mode with respect to electron emission. Within these modes, the device may operate in a diode or triode mode, and further may operate in a reflective or a transmissive mode. In the diode mode, the electron emitter is not gated, whereas in the triode mode the emitter is gated. Moreover, in the reflective mode, the target volume for the x-rays lies on the same side of the x-ray emitter surface or element as the electron impingement; in the transmissive mode the target volume for the x-rays lies on the opposite side of the x-ray emitter surface or element from the electron impingement.

Thus, in general, several exemplary modes of operation are (1) Field Emission (diode/transmissive); (2) Field Emission (diode/reflective); (3) Field Emission (triode/transmissive); (4) Field Emission (triode/reflective); (5) Thermionic Emission (diode/transmissive); (6) Thermionic Emission (diode/reflective); (7) Thermionic Emission (triode/transmissive); and (8) Thermionic Emission (triode/reflective). FIGS. 1, 2, and 4, discussed above, show examples of Field Emission (triode/transmissive) devices, while FIGS. 8 and 9 illustrate examples of a Thermionic Emission (diode/reflective) device.

FIG. 10 illustrates an example of a Thermionic Emission (diode/transmissive) device. The elements of these figures can be rearranged according to the principles set forth above to construct any of the other types of devices as well, since they illustrate transmissive and reflective operation, diode and triode operation, and thermionic and field emission operation.

While the embodiments of the invention described above have been discussed in the context of industrial application, such as large scale water purification and waste treatment, it will be appreciated that the described embodiments of the invention are also suitable for noncommercial settings. For example, in an embodiment of the invention, a small device according to the above described principles is associated with a home kitchen appliance to provide a purifying function. For example, such a device may be placed in line with a drinking water source such as at a faucet, refrigerator, coffee maker, etc. In addition, in an embodiment of the invention, a flow through treatment device as described above is used at a home to treat waste water, such as prior to passage to a septic tank or municipal sewer system.

In the above-described embodiments of the invention it was desirable to shield the device such that x-ray radiation did not extend outside of the device. However, in an alternative embodiment of the invention, it is desirable to irradiate materials outside rather than inside the device. For example, x-ray radiation can be used from inside a constricted space, such as a pipe or conduit, to check for cracks or other problematic situations. Conduit integrity is especially important in industrial and home plumbing as well as in specialized applications such as nuclear power plant cooling systems.

Figure 12:
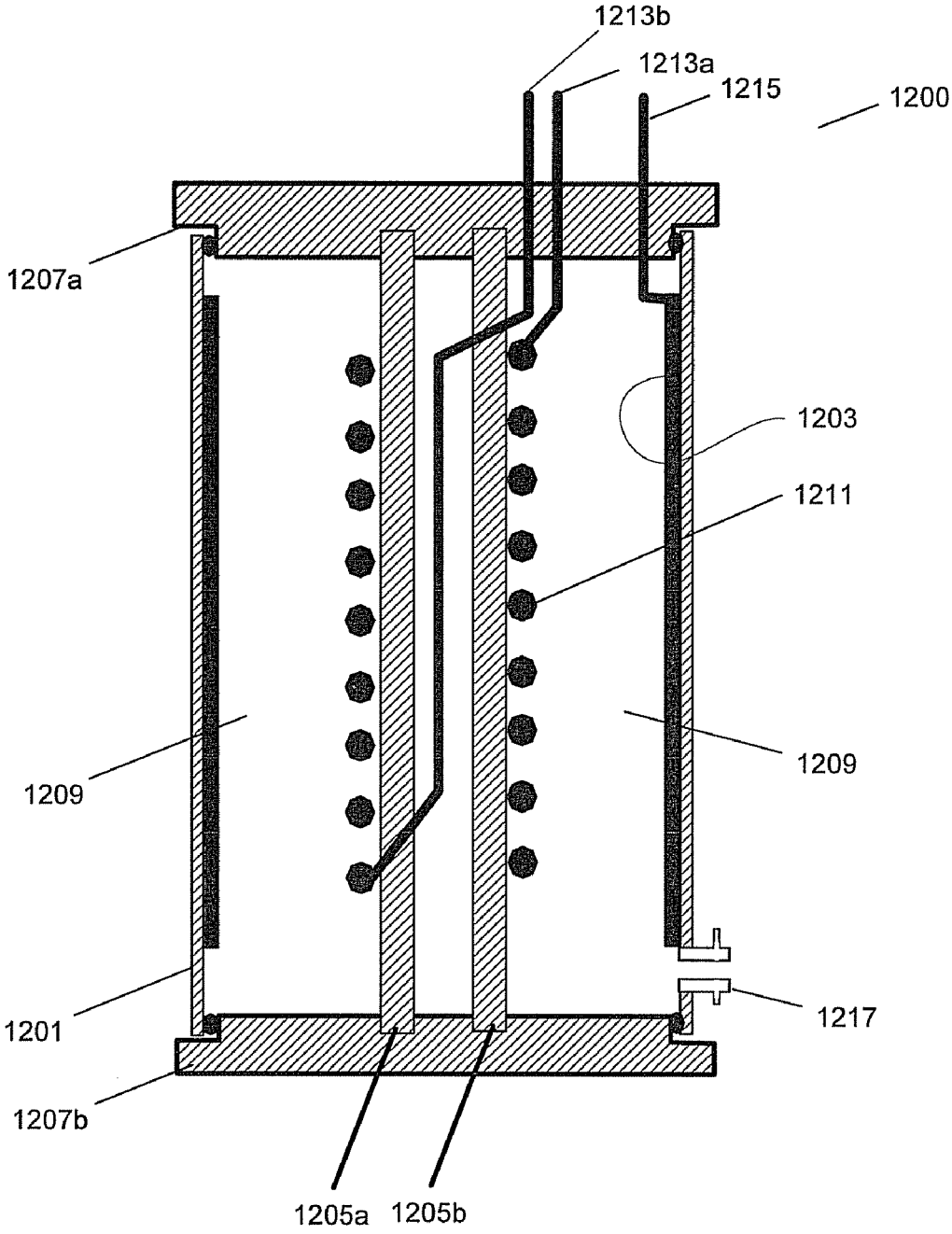
FIG. 12 is a cross-sectional side view of an x-ray generation apparatus according to a further alternative embodiment of the invention.

A device for generating x-rays and directing them outwardly is shown in FIG. 12. The device is similar to that of FIG. 8, but may be much smaller and does not have an axial flow-through opening. In greater detail, the device 1200 comprises a cylindrical outer shell 1201 having on the inner surface thereof a target material 1203. The target material may be any of the target materials discussed above, and is thin enough or diffuse enough so as not to shield generated x-rays. Similarly, the outer shell is composed of a material and configuration allowing significant x-ray transmission, such as a polymer material, graphite, beryllium, or thin metallic material.

Within the outer shell 1201, quartz support rods 1205*a* and 1205*b* are placed, and may be held in place by end caps 1207*a* and 1207*b*. End caps 1207*a* and 1207*b* also serve to seal the inner space 1209 defined by the outer shell 1201. A thermionic electron emission element 1211 is wrapped about the quartz support rods 1205*a* and 1205*b*. Although two such support rods are shown for simplicity, it will appreciated that a greater number of evenly spaced support rods, such as four or more rods, will allow a more uniform pattern of electron, and thus x-ray, generation. Leads 1213*a* and 1213*b* supply power to the electron emission element 1211, while lead 1215 applies a voltage to the target material 1203. An orifice 1217 may be used to evacuate the space 1209 for operation of the device. In operation, pumping may continue, or the orifice 1217 may be sealed.

Operation of the device is generally as discussed above. In particular, a voltage difference is applied between the thermionic electron emission element 1211 and the target material 1203. Electrons emitted by the thermionic electron emission element 1211 accelerate toward the target material 1203 under the influence of the applied field and strike the target material 1203. Responsive to this electron bombardment, the target material 1203 emits x-ray radiation. Since both the target material 1203 and the shell 1201 do not substantially shield such radiation, a portion of the generated radiation passes to the outside of the device, irradiating the device's current environment.

Figure 13:
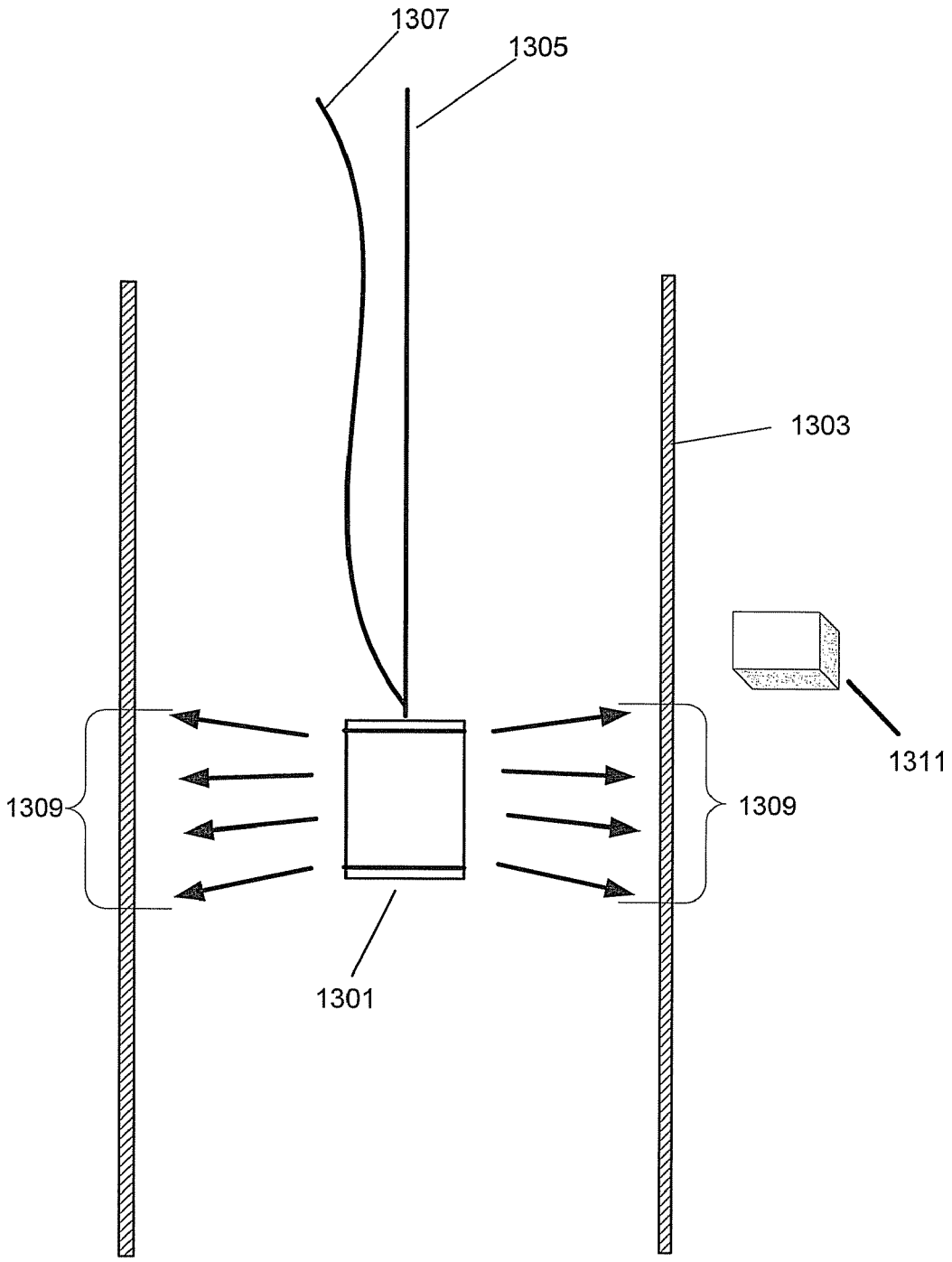
FIG. 13 is a schematic diagram of a use environment according to an embodiment of the invention for the device of FIG. 12.

A manner of using this device is described hereinafter with respect to FIG. 13. In particular, the device 1301 is illustrated being lowered inside a pipe 1303 to be analyzed. The device is preferably attached to a line 1305 for support. Leads 1307 used to operate the device are also attached to the device 1301. When powered, the device emits x-rays 1309 that impinge upon the wall of the pipe 1303. In order to analyze the pipe's 1303 integrity, the variance in transmission of x-rays through the pipe 1303 is detected by an x-ray detector 1311 placed outside the pipe 1303. Alternatively, an x-ray sensitive film may be wrapped around the outside of the device 1301, and used to detect flaws in the pipe via changes in the image intensity.

Note that although the device is illustrated being used in a particular environment, there is no limitation to that environment. For example, the illustrated device, if sized appropriately, can also be used for medical proposes. For example, such a device can be used for analyzing internal body structures such as veins and cavities, or for providing radiation to such structures. For example, such a device can be used to irradiate a specific site.

Although in the above example, both the target material 1203 and the shell 1201 were substantially transmissive to x-ray radiation, such is not a requirement. In particular, one or both of the target material 1203 and the shell 1201 may be opaque to x-ray radiation in selected locations to produce a desired output pattern. For example, a ring of transmissivity will produce a donut radiation pattern, while a stripe of transmissivity will produce a plane or sheet pattern.

Note that an electron bombardment device can be constructed using the same principles, namely, an electron emitter, a tubular member surrounding the electron emitter, and a voltage source for creating a field to accelerate emitted electrons from the electron emitter toward the tubular member. Electrons that pass through the tubular member and exit the device can then be used to irradiate external materials.

Figure 14:
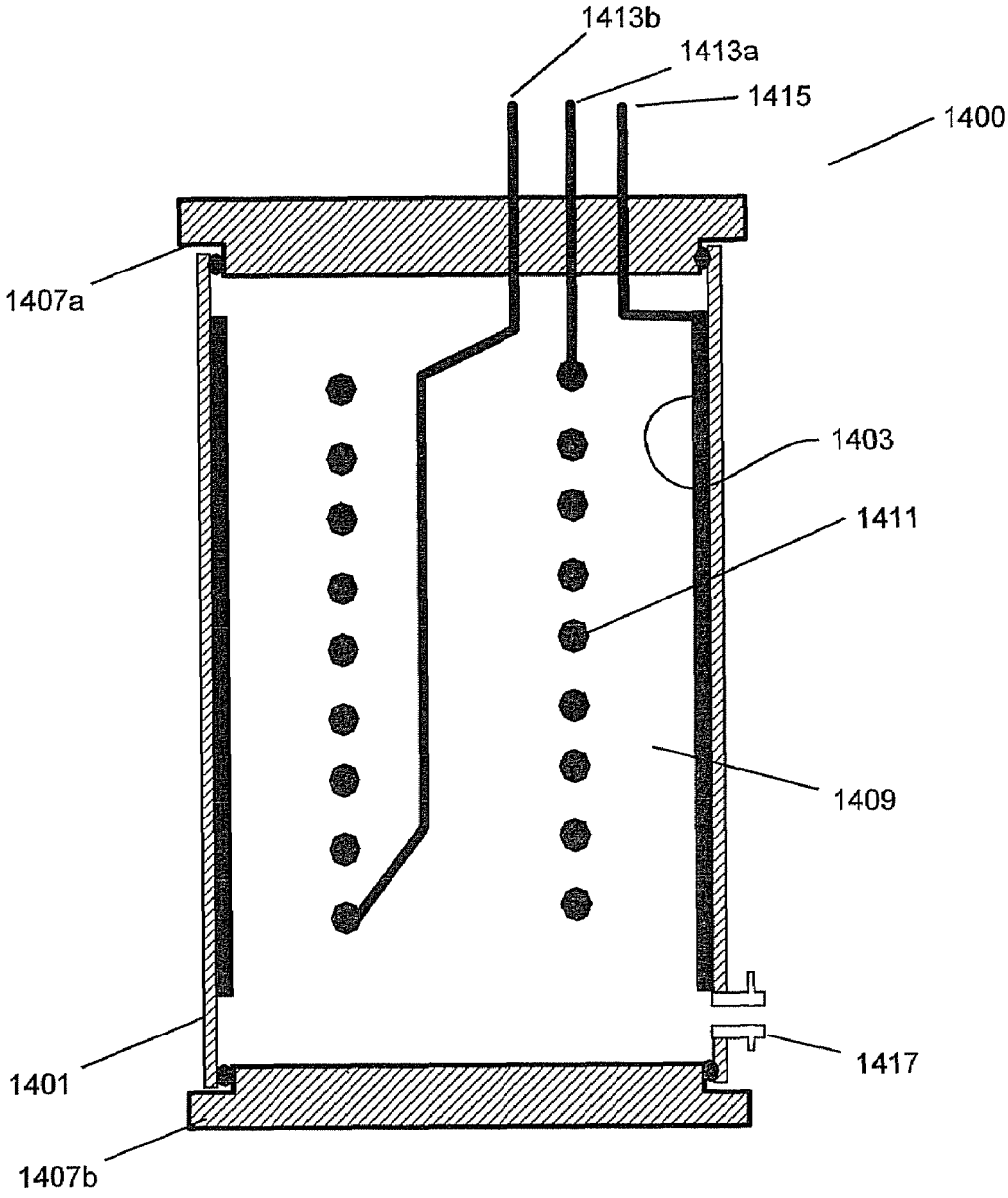
FIG. 14 is a cross-sectional side view of an x-ray emitting device according to an embodiment of the invention.

Although the foregoing discussion has focused on devices that operate in one of either a reflective or a transmissive mode, devices are possible which utilize both modes of operation simultaneously. FIG. 14 illustrates, in cross-sectional side view, one such device according to an embodiment of the invention. The device 1400 is similar to that of FIG. 12, but it is shown separately to more clearly describe its distinct mode of operation.

The device 1400 comprises a cylindrical outer shell 1401 having on its inner surface a target material 1403. Again, the target material is thin or diffuse enough so as not to substantially shield generated x-rays. Similarly, the outer shell 1401 is composed of a material and configuration allowing significant x-ray transmission as discussed above. End caps 1407*a* and 1407*b* serve to seal the inner space 1409 defined by the outer shell 1401. A thermionic electron emission element 1411 is situated within, and is approximately concentric with, the outer shell 1401. The thermionic electron emission element 1411 may be structurally self-supporting or may supported by arms, rods, etc., not shown.

Leads 1413*a* and 1413*b* supply power to the electron emission element 1411, and lead 1415 applies a voltage to the target material 1403. As with the device of FIG. 12 discussed above, orifice 1417 may be used to evacuate the space 1409 for operation of the device 1400, and may be sealed if pumping is discontinued for use of the device 1400.

In operation, a voltage difference is applied between the thermionic electron emission element 1411 and the target material 1403. Electrons emitted by the thermionic electron emission element 1411 accelerate toward the target material 1403 under the influence of the applied field and strike the target material 1403. As a result, the target material 1403 emits x-ray radiation. As noted above, both the target material 1403 and the shell 1401 do not substantially shield such radiation. Thus, a portion of the generated radiation passes to the outside of the device 1400. In addition, another portion of the generated radiation is reflected inwardly towards the opposite wall of the outer shell 1401. Upon traversing the cavity within the outer shell 1401, a portion of the reflected radiation passes through the opposite wall of the outer shell 1401 and exits the device 1400. It can be seen that this modified mode of operation increases efficiency given that initially reflected x-rays may still exit the device 1400, albeit on the opposite side.

In an alternative embodiment of the invention related to that shown in FIG. 14, the device further comprises an inner tubular member also coated with x-ray emitting target material. The acceleration field is further maintained between the electron emitter and both tubular members, such that electrons accelerate both inwardly and outwardly from the electron emitter and strike both target surfaces. The outer surface performs as described above. The inner surface may be thicker and operates in the reflective mode relative to the inner tube. That is, the x-rays generated at the x-ray emitting target material on the inner tube are directed towards the outer tube and substantially pass through the outer tube.

It will be appreciated that new and useful x-ray generation techniques and devices have been described herein. In view of the many possible embodiments to which the principles of this invention may be applied, it should be recognized that the embodiments described herein with respect to the drawing figures are meant to be illustrative only and should not be taken as limiting the scope of invention. For example, those of skill in the art will recognize that the precise configurations and shapes shown are exemplary and that the illustrated embodiments can thus be modified in arrangement and detail without departing from the spirit of the invention. For example, it will be appreciated that any of the illustrated shapes or otherwise may also be modified to include non-concave portions or elements such as a flare or flange at one or more edges, and that such does not negate the substantial concavity of the affected member.

Although certain numerical examples have been given herein, it will be appreciated that the invention applies equally to devices and systems on a much larger or much smaller scale without limitation. Likewise, although generally smooth members have been illustrated herein, it will be appreciated that a generally concave member may itself be made up of many individual flat components such as strips or polygons. For example, tubes having polygonal cross sections could be used in the apparatus of FIG. 1 in place of the members having circular cross sections. Finally, it is contemplated that not only fluids (including liquids and gasses) but also solids may be passed through and treated by a system such as described herein. Instead of being flowed through the system, solids are preferably conveyed, such as by belt or shaker. Moreover, although the described embodiments of the invention have focused upon x-ray generation, it will be appreciated that the principles of the invention may also be used to provide electron radiation of materials without x-ray generation. For example, in the device of FIG. 1, if the target layer 115 is made substantially transparent to electrons and the inner tube 103 is relatively transparent to electrons, then the device may be used to provide electron irradiation of the contents of volume 127. Therefore, the invention as described herein contemplates all such embodiments as may come within the scope of the following claims and equivalents thereof.

We claim:

1. A method of generating wide-angle x-ray radiation from a portable housing comprising:

generating electrons within the housing, the housing defining an interior space, the housing further being responsive to electron bombardment to produce x-ray radiation;

accelerating the generated electrons toward the housing;

allowing at least a portion of the generated electrons to strike the housing, whereby x-ray radiation is generated;

passing a portion of the generated x-ray radiation through the housing and reflecting a portion of the generated x-ray radiation from the housing; and passing the reflected portion of the generated x-ray radiation through the interior space and then passing at least some of the reflected portion of the generated x-ray radiation through the housing.

2. The method according to claim 1, wherein the step of generating electrons comprises using a gated electron emitter.

3. The method according to claim 1, wherein the step of generating electrons comprises using a thermionic electron emitter.

4. The x-ray generation apparatus according to claim 1, wherein the interior space is sealed and is evacuated to less than ambient pressure.

5. The x-ray generation apparatus according to claim 4, wherein the interior space is evacuated to less than $10^{-5}$ torr.

* * * * *